US009275597B2

(12) United States Patent
Miyatake et al.

(10) Patent No.: US 9,275,597 B2
(45) Date of Patent: Mar. 1, 2016

(54) DISPLAY DEVICE

(71) Applicant: Japan Display Inc., Minato-ku (JP)

(72) Inventors: Masaki Miyatake, Tokyo (JP); Akihiko Saitoh, Tokyo (JP)

(73) Assignee: Japan Display Inc., Minato-ku (JP)

( * ) Notice: Subject to any disclaimer, the term of this patent is extended or adjusted under 35 U.S.C. 154(b) by 0 days.

(21) Appl. No.: 14/219,134

(22) Filed: Mar. 19, 2014

(65) Prior Publication Data

US 2014/0285413 A1 Sep. 25, 2014

(30) Foreign Application Priority Data

Mar. 22, 2013 (JP) ..... 2013-060816

(51) Int. Cl.
*G09G 3/36* (2006.01)
*G09G 3/32* (2006.01)

(52) U.S. Cl.
CPC ..... *G09G 3/3688* (2013.01); *G09G 3/3677* (2013.01); *G09G 3/3225* (2013.01); *G09G 2320/0247* (2013.01); *G09G 2330/025* (2013.01); *G09G 2330/026* (2013.01)

(58) Field of Classification Search
CPC ..... G09G 3/3677; G09G 2310/0245; G09G 2310/0286; G09G 2320/0257
See application file for complete search history.

(56) References Cited

U.S. PATENT DOCUMENTS

| | | | | |
|---|---|---|---|---|
| 7,187,421 | B2 | 3/2007 | Tsunashima et al. | |
| 2005/0036078 | A1 * | 2/2005 | Tsunashima et al. | 349/38 |
| 2005/0201508 | A1 * | 9/2005 | Shin et al. | 377/10 |
| 2007/0013573 | A1 * | 1/2007 | Hashimoto | 341/172 |

FOREIGN PATENT DOCUMENTS

| | | |
|---|---|---|
| JP | 2005-049849 | 2/2005 |
| KR | 10-2005-0009154 | 1/2005 |
| KR | 10-2005-0091378 | 9/2005 |
| TW | I279760 | 4/2007 |
| WO | WO 2009028353 A1 * | 3/2009 |

OTHER PUBLICATIONS

Office Action mailed Sep. 26, 2015 for Korean Application No. 10-2014-0031897 (with English translation).
Office Action issued Dec. 25, 2015, in Taiwanese Patent Application No. 103110164, with English-language Translation.

* cited by examiner

*Primary Examiner* — Dorothy Harris
(74) *Attorney, Agent, or Firm* — Oblon, McClelland, Maier & Neustadt, L.L.P.

(57) ABSTRACT

According to one embodiment, a display device includes signal lines, scanning lines, pixel switching elements, a signal line driving circuit, a scanning line driving circuit and a display pixel, wherein the signal line driving circuit is configured to apply a voltage, which is identical to a voltage of the counter-electrode, to all the signal lines when a control signal, which is supplied from an outside of the insulative substrate, is at a first logic level, and the scanning line driving circuit is configured to turn on all the pixel switching elements when the control signal is at the first logic level, and to turn off the pixel switching elements at different timings when the control signal is at a second logic level.

4 Claims, 10 Drawing Sheets

DISPLAY DEVICE

CROSS-REFERENCE TO RELATED APPLICATIONS

This application is based upon and claims the benefit of priority from Japanese Patent Application No. 2013-060816, filed Mar. 22, 2013, the entire contents of which are incorporated herein by reference.

FIELD

Embodiments described herein relate generally to a display device.

BACKGROUND

By virtue of small thickness, light weight and low power consumption, display devices, which are typified by liquid crystal display devices, have been used as displays of various kinds of apparatuses. Active matrix display devices, among others, have been gaining in popularity as displays of notebook-type personal computers and portable information terminals.

In the meantime, in the liquid crystal display device, if a voltage of a same polarity continues to be applied to a liquid crystal, a display defect occurs. Thus, polarity-inversion driving is adopted, in which a polarity of a voltage applied to the liquid crystal layer is switched at regular intervals. When the polarity-inversion driving is executed, it is necessary to cyclically change the polarity of the voltage of a power supply line. For this purpose, a plurality of reference power sources are prepared in advance.

However, at a time of power-on, it is uncertain to which of the reference power sources the power line is connected. As a result, the voltage applied to the liquid crystal layer varies, and there arises a problem that a display defect, such as flickering, is visually recognized. To cope with this problem, there has been proposed a display device which is configured such that no display defect is visually recognized at a time of power-on.

In the proposed invention, however, the power supply voltage is applied to all pixels at a time of power-on. Thus, when this invention is applied hereafter to a display device, such as FHD (full high-vision), which has a higher resolution than a conventional display device, an instantaneous current due to switching of the power supply voltage increases, and, consequently, a load on a driving circuit increases, leading to a cause of the occurrence of a fault of the display device. In addition, due to the increase in electric current, there is concern that the specifications, which are required for the display device, are judged to be unachieved.

BRIEF DESCRIPTION OF THE DRAWINGS

A general architecture that implements the various features of the invention will now be described with reference to the drawings. The drawings and the associated descriptions are provided to illustrate embodiments of the invention and not to limit the scope of the invention.

DETAILED DESCRIPTION

Various embodiments will be described hereinafter with reference to the accompanying drawings.

In general, according to one embodiment, a display device includes a display device comprising: signal lines and scanning lines extending in a first direction and a second direction respectively on an insulative substrate; pixel switching elements formed near intersections between the signal lines and the scanning lines; a signal line driving circuit configured to drive the signal lines; a scanning line driving circuit configured to drive the scanning lines; and a display pixel, which comprises a pixel electrode connected to the pixel switching element and a counter-electrode opposed to the pixel electrode and a storage capacitance, wherein the signal line driving circuit is configured to apply a voltage, which is identical to a voltage of the counter-electrode, to all the signal lines when a control signal, which is supplied from an outside of the insulative substrate, is at a first logic level, and the scanning line driving circuit is configured to turn on all the pixel switching elements when the control signal is at the first logic level, and to turn off the pixel switching elements at different timings when the control signal is at a second logic level.

[First Embodiment]

Figure 1:
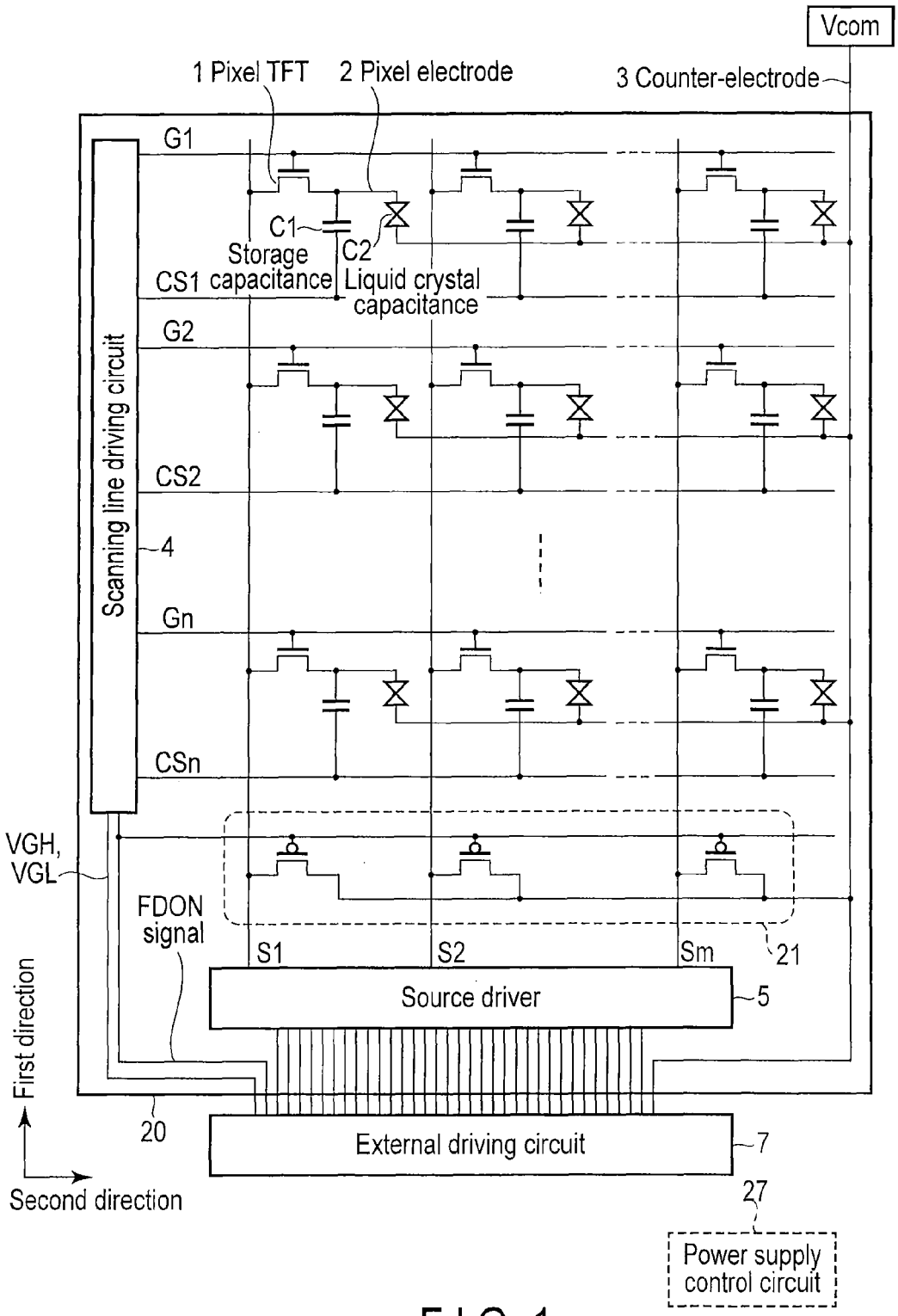
FIG. 1 PRIOR ART
FIG. 1 is an exemplary block diagram illustrating a structure of a display device which was studied prior to a display device according to a first embodiment.

FIG. 1 is a block diagram illustrating a structure of a display device which was studied prior to a display device according to a first embodiment. An active matrix liquid crystal display device will be described below by way of example.

The liquid crystal display device of FIG. 1 includes signal lines S1 to Sm extending in a first direction on a glass substrate, and scanning lines G1 to Gn extending in a second direction. Pixel TFTs (Thin Film Transistors) 1 are formed near intersections between the signal lines and scanning lines. A drain terminal of the pixel TFT 1 is connected to a storage capacitance C1 and a pixel electrode 2. A liquid crystal capacitance C2 is formed between the pixel electrode 2 and a counter-electrode 3, which is disposed to be opposed to the pixel electrode 2 with a liquid crystal layer interposed.

A scanning line driving circuit 4 drives the scanning lines G1 to Gn. A source driver 5 drives the signal lines S1 to Sm. The storage capacitances C1, which are arranged in the scanning line direction (second direction), are commonly connected at one end to a storage capacitance power line, CS1 to CSn. A number of storage capacitance power lines CS1 to CSn, which is equal to the number of pixels in the first direction, are provided, and a voltage, which is identical to a voltage of the counter-electrode, is applied to the storage capacitance power lines CS1 to CSn.

An external driving circuit 7 is provided on the outside of a glass substrate 20, or is mounted on the glass substrate 20. The glass substrate 20 and external driving circuit 7 are connected by an FPC (Flexible Print Circuit) or the like. The source driver 5 is mounted on the glass substrate 20. The external driving circuit 7 sends/receives pixel data, control signals, etc. to/from the source driver 5.

In addition, the scanning line driving circuit 4 and a signal line voltage control circuit (FDON circuit) 21 are provided on the glass substrate 20. A control signal FDON is supplied from the external driving circuit 7 to the scanning line driving circuit 4 and signal line voltage control circuit 21. By this control signal FDON, control is executed to suppress a display defect (non-uniformity in display) at a time of power-on. Incidentally, a high voltage VGH and a low voltage VGL are supplied from the external driving circuit 7 to the scanning line driving circuit 4.

Figure 2:
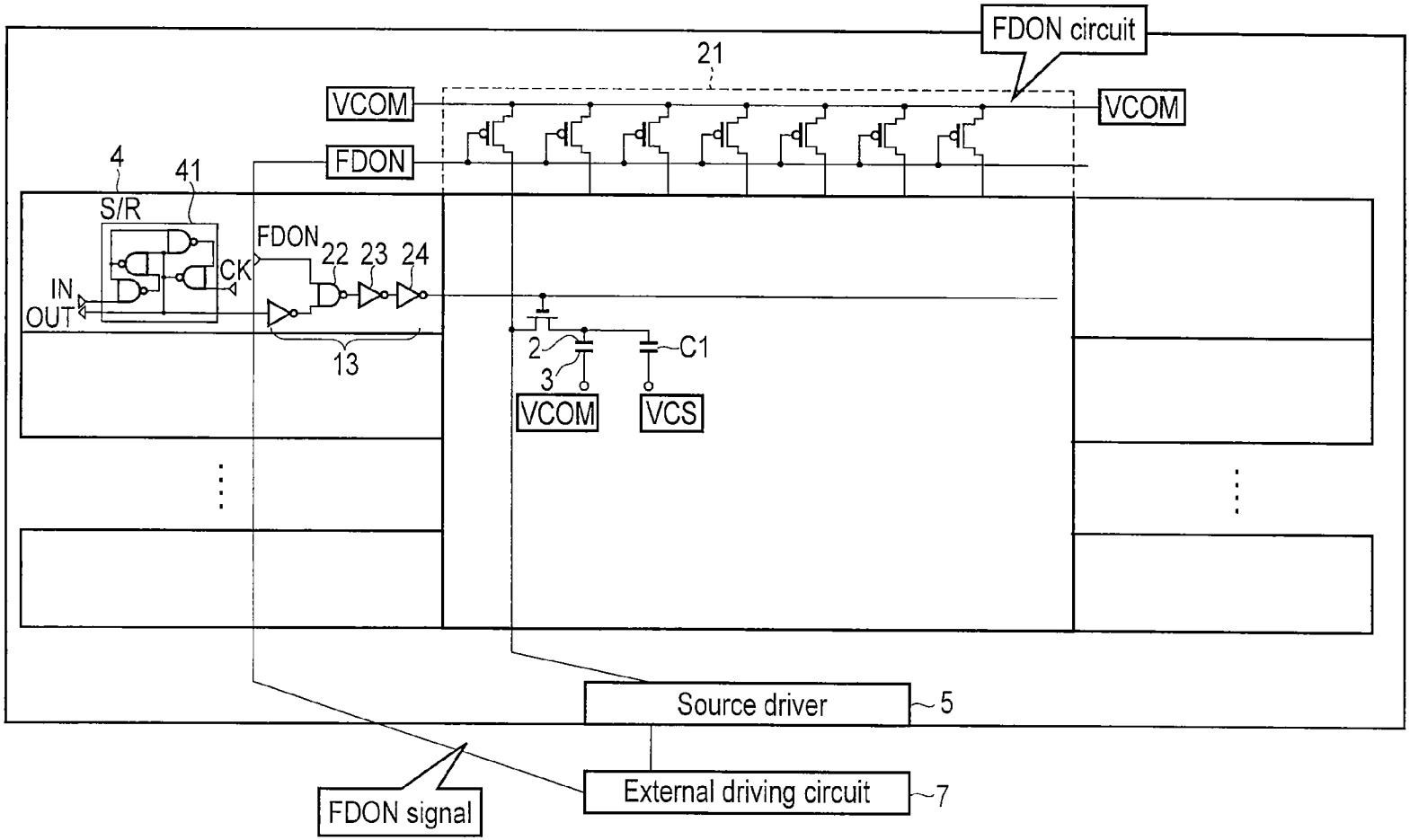
FIG. 2 PRIOR ART
FIG. 2 is an exemplary view for explaining an operation relating to a control signal of the display device which was studied prior to the display device of the first embodiment.

FIG. 2 is a view for explaining an operation relating to the control signal FDON of the display device which was studied prior to the display device of the first embodiment. For the purpose of convenience of description, only necessary signals are depicted in a simplified fashion, and only a part of the scanning line driving circuit 4 is depicted. In addition, the signal line voltage control circuit 21 is depicted in the upper part.

In the scanning line driving circuit 4, a logic circuit 41 and a buffer circuit 13, which constitute a shift register, are provided as a generation circuit for generating a scanning signal. As illustrated, a NAND circuit 22 and two-stage inverters 23 and 24, which are connected in tandem to an output terminal of the NAND circuit 22, are provided in association with each scanning line. The NAND circuit 22 executes an arithmetic operation of an inverted logical product between a timing signal for scanning line driving, which is an output from the logic circuit 41, and the control signal FDON.

When the control signal FDON is at a low level (first logic level), the output of the NAND circuit 22 is at a high level and the scanning level is also at a high level. Accordingly, all pixel TFTs 1, which are connected to this scanning line, are turned on. On the other hand, the control signal FDON is supplied to all NAND circuits 22 in the scanning line driving circuit 4. Thus, when the control signal FDON is at the low level, all pixel TFTs 1 in the display area are turned on.

The signal line voltage control circuit 21 includes a plurality of PMOS transistors which are connected to the respective signal lines. The control signal FDON is supplied to the gates of these PMOS transistors. In addition, a voltage (hereinafter referred to as "Vcom"), which is identical to the voltage of the counter-electrode, is applied to the drains of the PMOS transistors.

If the control signal FDON goes to the low level, all PMOS transistors in the signal line voltage control circuit 21 are turned on, and Vcom is supplied to all signal lines. Thus, Vcom is delivered to both the pixel electrode 2 and counter-electrode 3. Accordingly, the voltages at both ends of the liquid crystal capacitance C2 become substantially equal, and non-uniformity in display is made visually nonrecognizable.

Figure 3:
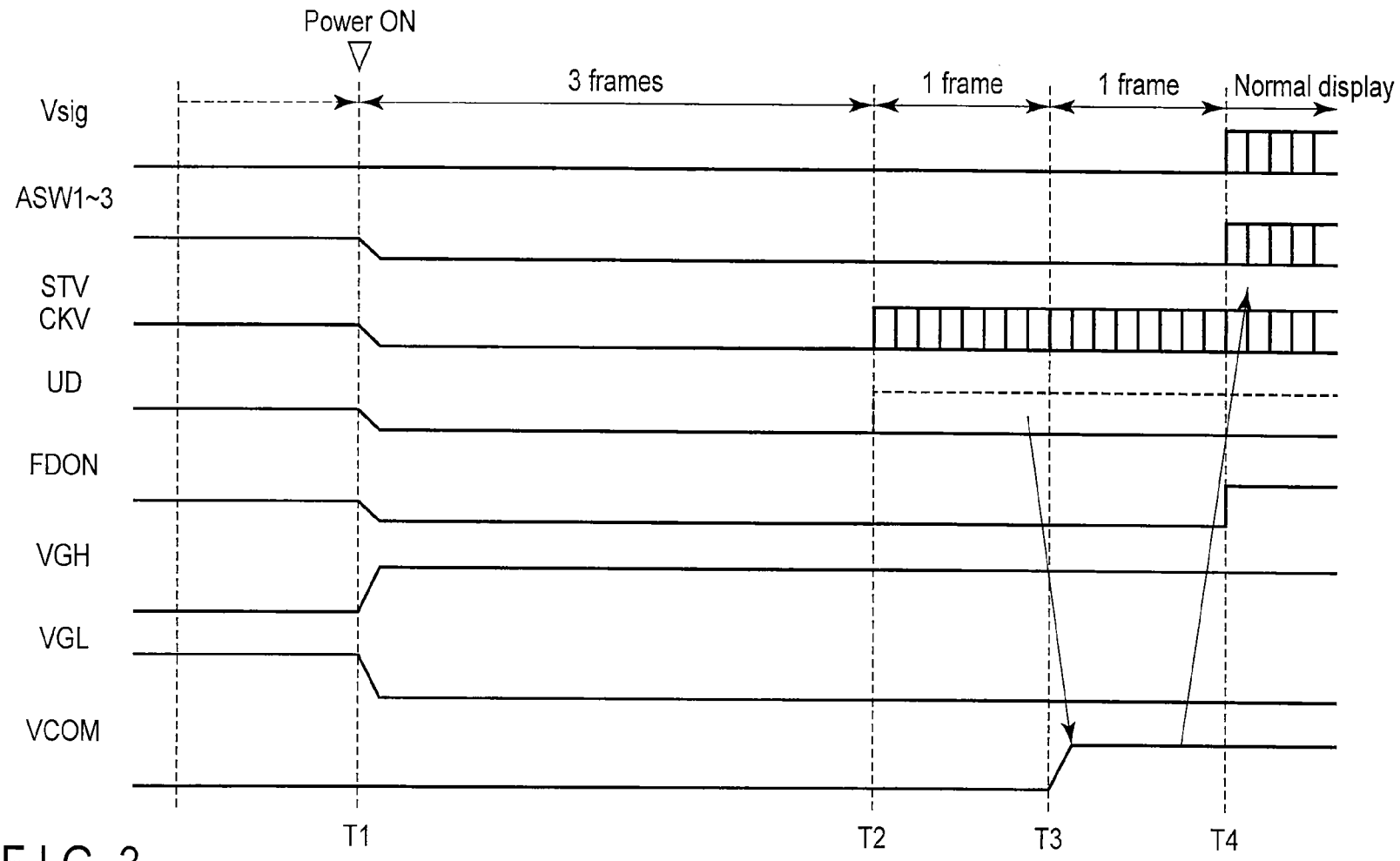
FIG. 3 PRIOR ART
FIG. 3 is an exemplary time chart at a time of power-on of the display device which was studied prior to the display device of the first embodiment.

FIG. 3 is a time chart at a time of power-on of the display device which was studied prior to the display device of the first embodiment.

The signals illustrated in FIG. 3 are as follows. Vsig represents a pixel voltage which is supplied from the source driver 5. ASW 1-3 are signals for selecting sub-pixels of red (R), green (G) and blue (B), which constitute one pixel. Vsig is supplied from the source driver 5 to a signal line corresponding to the selected sub-pixel. STV is a start signal for the scanning line driving circuit 4. CKV is a clock signal for driving the shift register. UD is a signal for designating a direction (up→down, down→up) in which video is displayed on the display device. FDON is a control signal for suppressing non-uniformity in display at a time of power-on. High voltage VGH, low voltage VGL and counter-voltage Vcom are power supply voltages which are generated by a power supply control circuit 27 of the display device and are supplied to the respective parts.

Next, referring to FIG. 3, a display non-uniformity suppressing operation at a time of power-on is described.

Before a timing T1 at which power is turned on, the states of the respective signals are uncertain. If power is turned on at timing T1, the signals ASW 1-3, STV, CKV, UD and FDON are set at low levels, respectively. In addition, the power supply voltages VGH and VGL change to predetermined voltages. On the other hand, Vcom goes into an uncertain state. This state is maintained for a period of three frames. The three frames are a period for warming-up, and a proper number of frames may be set for each display device.

At a timing T2, the signals STV, CKV and UD are input. In FIG. 3, although the details of the signals are not depicted, the signals STV and CKV are the same signals as those at a time of normal display operation. In this period, however, no signal is given for Vsig, and ASW 1-3 are inoperative. Accordingly, only the scanning line driving circuit 4 executes the operation. Thereby, a reset operation is executed for clearing a residual charge in the scanning line driving circuit.

At a timing T3, boost of Vcom is started. In this state, the control signal FDON is at the low level. Accordingly, all PMOS transistors in the signal line voltage control signal 21 are turned on, and Vcom is supplied to the signal line. In the meantime, as described above, when the control signal FDON is at the low level, the output of the NAND circuit 22 goes to the high level, and the scanning line also goes to to the high level. Thus, the pixel TFT 1 is turned on, and Vcom is applied to both the pixel electrode 2 and counter-electrode 3. Accordingly, for example, in a normally-black liquid crystal mode, since a black level is displayed on the entire screen, non-uniformity in display is eliminated.

At a timing T4, FDON is released. Specifically, since the control signal FDON is set at a high level (second logic level), all PMOS transistors in the signal line voltage control circuit 21 are turned off, and Vcom is no longer supplied to the signal line. On the other hand, at the timing T4, a video signal is given for Vsig, and ASW 1-3 start to operate. Accordingly, Vsig is supplied to the signal line S, and the display operation is started.

Figure 4:
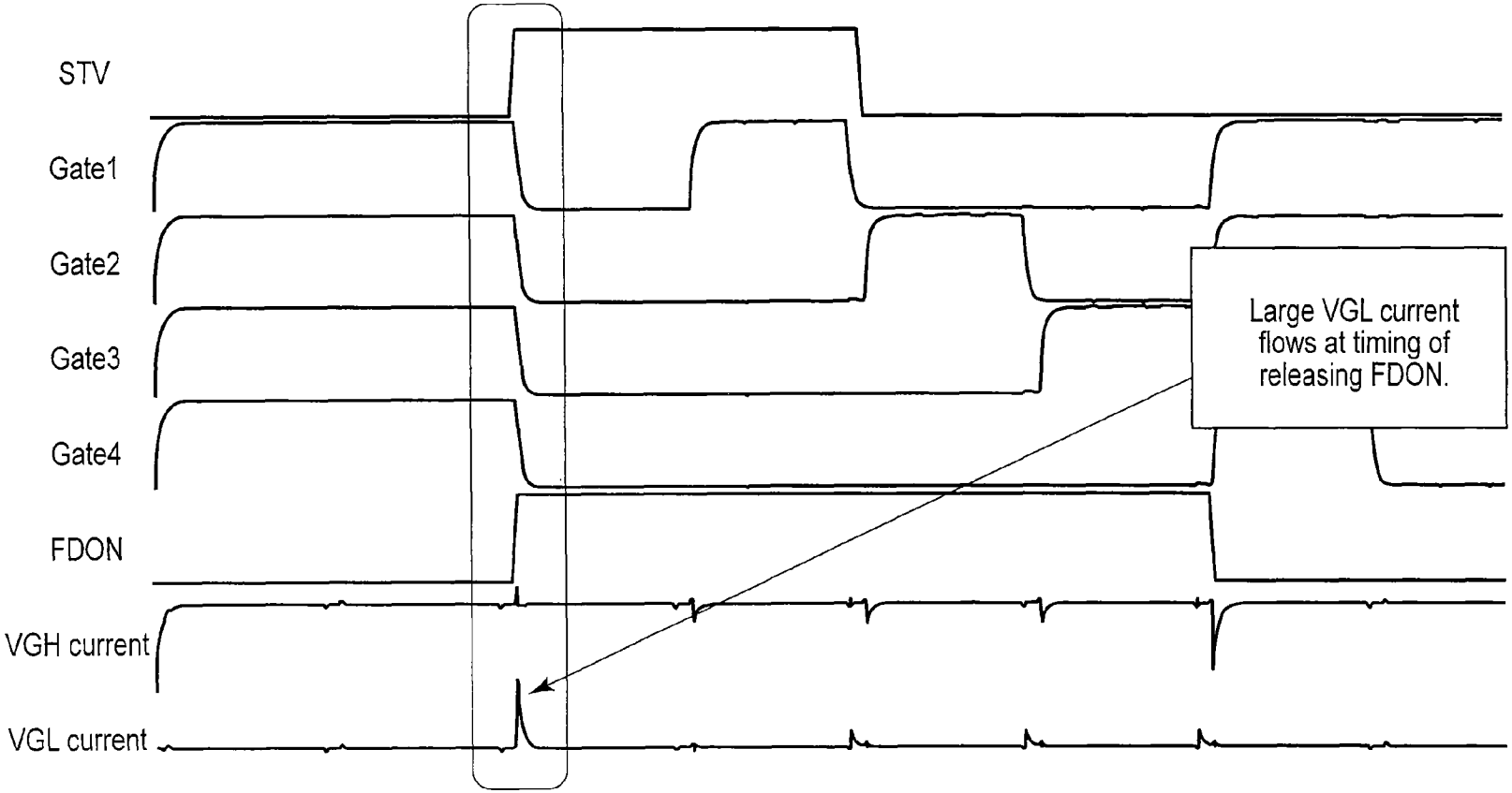
FIG. 4 PRIOR ART
FIG. 4 is an exemplary time chart for explaining a problem at a time of power-on of the display device which was studied prior to the display device of the first embodiment.

FIG. 4 is a time chart for explaining a problem at a time of power-on of the display device which was studied prior to the display device of the first embodiment.

The signals illustrated in FIG. 4 are as follows. Gates 1-4 are gate signals for driving the pixel TFTs 1, which are output to gate lines G1 to G4. VGH current and VGL current are currents measured by the power supply control circuit 27 which supplies high voltage VGH and low voltage VGL. Since the other signals have already been described, an overlapping description is omitted.

Next, a problem at a time of power-on will be described with reference to FIG. 4.

In a period in which the control signal FDON is at the low level, high-level signals (VGH voltage) for turning on pixel TFTs 1 are output to all of the gate lines Gate 1 to Gate 4, as described above. If the control signal FDON goes to the high level, the levels of the gate signals Gate 1 to Gate 4 are switched from the high level (VGH voltage) to the low level (VGL voltage). Thereafter, the gate signals Gate 1 to Gate 4 become scanning pulse signal which are sequentially driven, and the display operation is executed.

Incidentally, although four gate signals are depicted in FIG. 4, for example, 1920 gate lines are provided in a display device of FHD (full high-vision). Accordingly, when FDON has been released, 1920 signals are switched at the same time from the use of VGH voltage to the use of VGL voltage. As a result, a large instantaneous VGL current flows.

In this manner, since the large instantaneous current flows each time power is turned on, a load on circuit elements of the display device increases. By the continuous repetition of this state, the degradation of circuit elements is accelerated, leading to a cause of the occurrence of a fault.

Next, a method of solving the above problem is described.

Figure 5A:
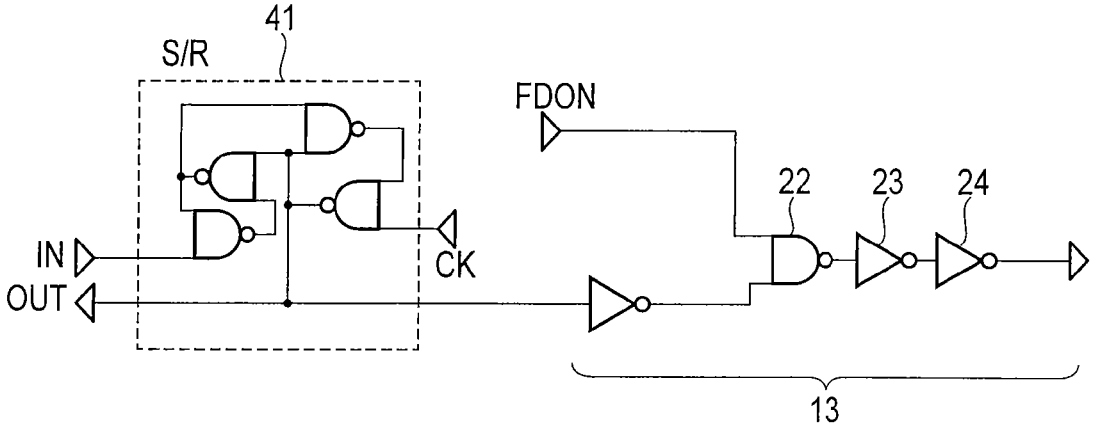
F I G. 5A PRIOR ART
FIG. 5A is an exemplary view for describing a scanning line driving circuit of the display device of the first embodiment.
Figure 5B:
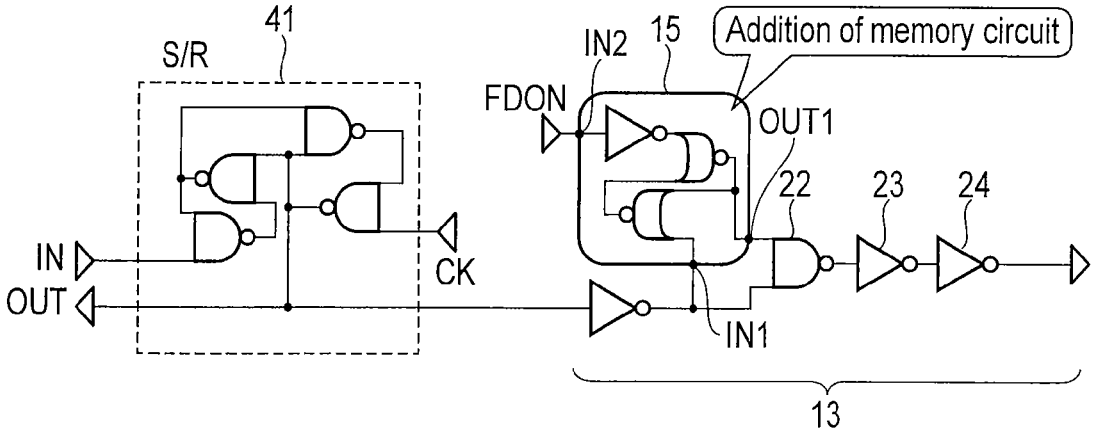
FIG. 5B is an exemplary view for describing a scanning line driving circuit of the display device of the first embodiment.

FIG. 5A and FIG. 5B are views for describing a scanning line driving circuit of the display device of the first embodiment. FIG. 5A illustrates a schematic structure of a scanning line driving circuit which was used in the above-described study, and FIG. 5B illustrates a schematic structure of a scanning line driving circuit of the display device of the first embodiment.

As shown in FIG. 5B, in the buffer circuit 13, a memory circuit 15 is newly provided. An output signal of the logic circuit 41, which constitutes the shift register, is supplied to an input terminal IN1 of the memory circuit 15, and a control signal FDON is supplied to an input terminal IN2 of the memory circuit 15. An output terminal OUT1 of the memory circuit 15 is connected to one input terminal of the NAND circuit 22. An output signal of the logic circuit 41 is input to the other input terminal of the NAND circuit 22. The subsequent circuit configuration is the same as the configuration of the above-described buffer circuit 13.

The memory circuit 15 is composed of a sequence circuit, and even when the control signal FDON has changed from the low level to high level, the level of the output terminal OUT1 does not change until a pulse signal that is a shift register output is output from the logic circuit 41.

Figure 6:
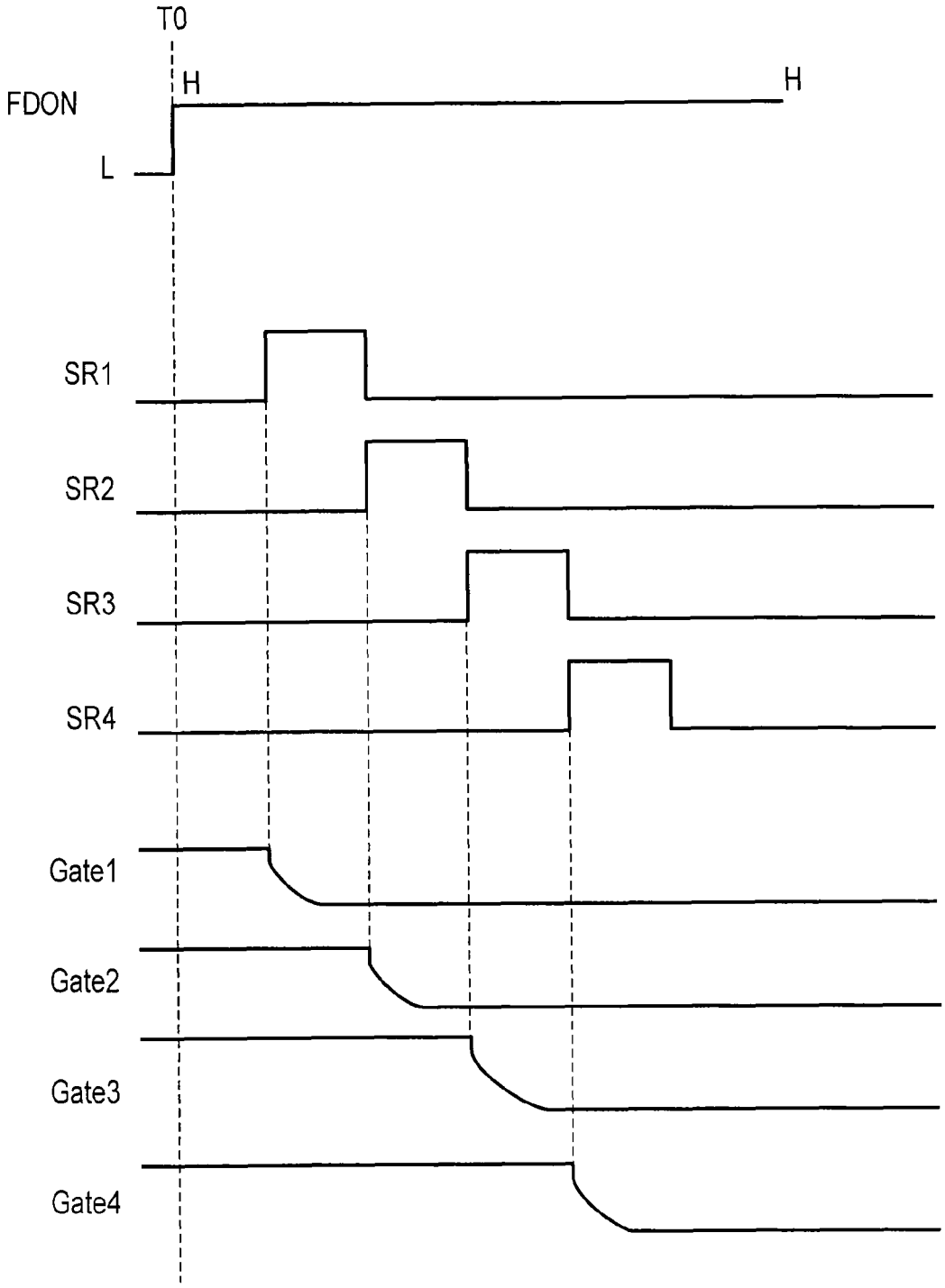
FIG. 6 is an exemplary time chart for explaining an operation of the scanning line driving circuit of the display device of the first embodiment.

FIG. 6 is a time chart for explaining an operation of the scanning line driving circuit of the display device of the first embodiment. This time chart illustrates the control signal FDON, output signals SR of the logic circuit, and gate signals Gate which are output to scanning lines.

At a timing T0, the control signal FDON changes from the low level to high level. However, by the above-described memory circuit 15, the gate signals Gate are kept at the high level. Then, if output signals SR1, . . . , SR4 are output, the gate signals Gate1, . . . , Gate4 change to the low level at the respective timings. After a gate signals Gate were changed to the low level, the gate signals, which are subsequently input to the scanning lines become scanning pulse signals for sequential driving, and the display operation is executed.

Figure 7:
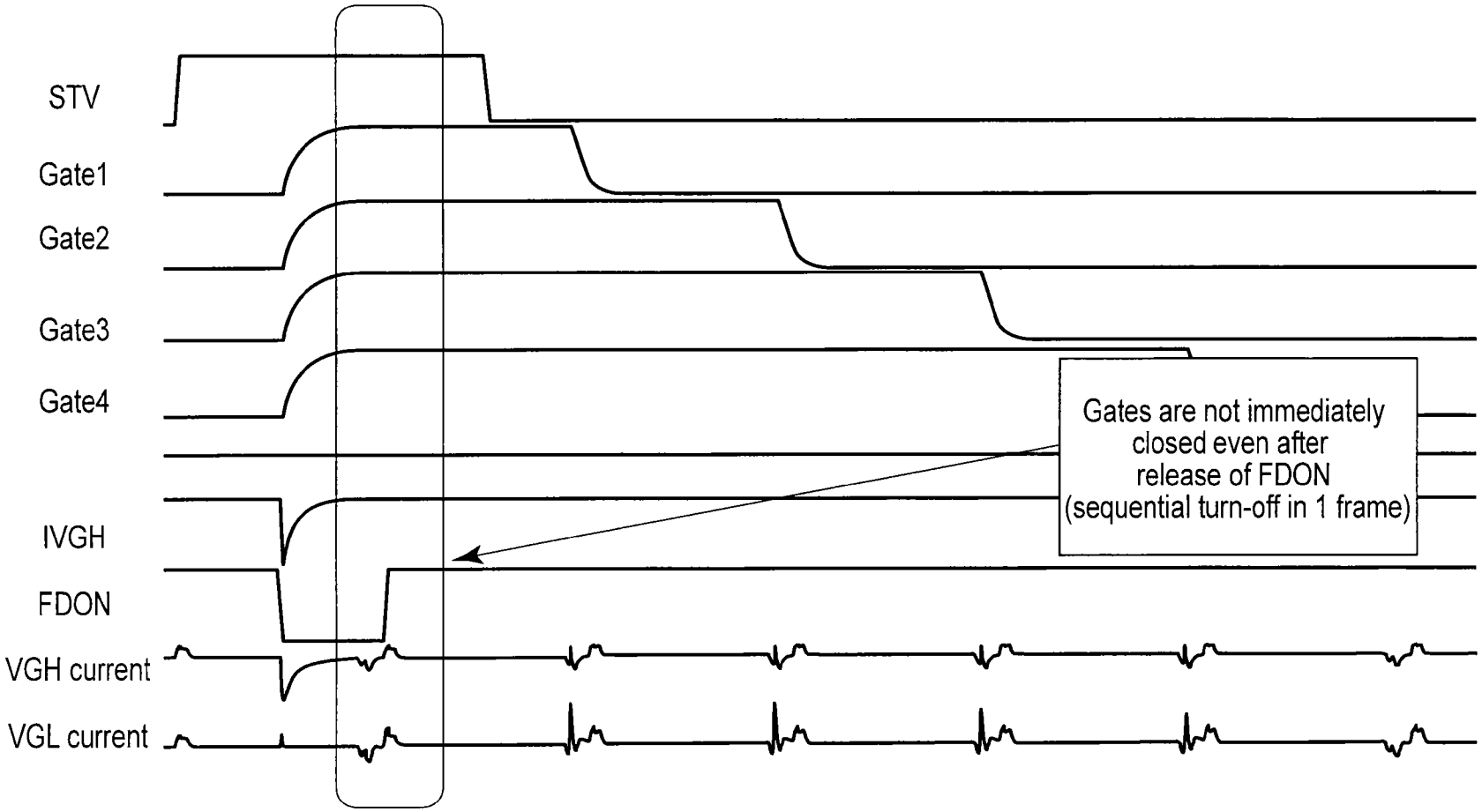
FIG. 7 is an exemplary time chart for explaining an operation at a time of power-on of the display device of the first embodiment.

FIG. 7 is a time chart for explaining an operation at a time of power-on of the display device of the first embodiment.

When the control signal FDON has changed to the low level, the gate signals Gate1, . . . , Gate4 change to the high level at the same time. Subsequently, although the control signal FDON changes to the high level, the gate signals Gate1, . . . , Gate4 are kept at the high level by the operation of the memory circuit 15, as described above. Then, at a timing when output signals (not shown) have been output from the logic circuit 41 that constitutes the shift register, the gate signals Gate1, . . . , Gate4 successively change to the low level.

In this manner, even when the control signal FDON has been released, the gate signals do not change to the low level at a time, but the gate signals successively change to the low level in 1 frame period. Therefore, the flow of a large instantaneous VGL current can be avoided.

In the 1 frame period in which the gate signals are successively changed to the low level, the voltage that is applied to the signal line S is not particularly specified. However, it is desirable that Vsig be not supplied from the source driver 5 to the signal line S, without ASW1 to ASW3 being operated. On the other hand, ASW1 to ASW3 may be operated and Vcom may be output as Vsig signal to the signal line S from the source driver 5.

[Second Embodiment]

In a second embodiment, the structure of the scanning line driving circuit differs from that in the first embodiment. The same parts as in the first embodiment are denoted by like reference numerals, and a detailed description thereof is omitted.

Figure 8:
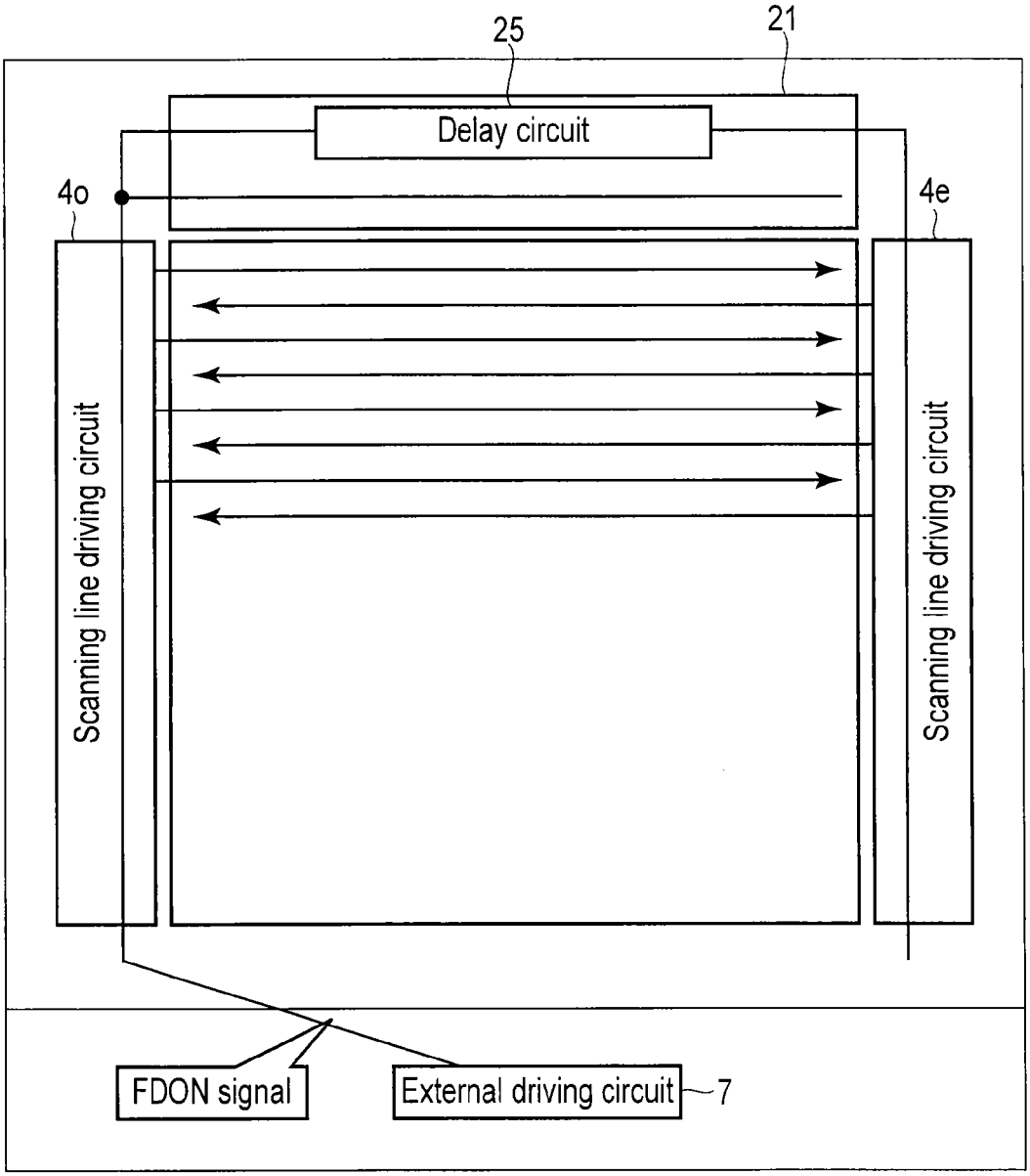
FIG. 8 is an exemplary view for explaining an operation relating to a control signal of a display device of a second embodiment.

FIG. 8 is a view for explaining an operation relating to a control signal FDON of a display device of the second embodiment. For the purpose of convenience of description, only necessary signals are depicted in a simplified fashion. In addition, the signal line voltage control circuit 21 is depicted in the upper part.

In the second embodiment, the scanning line driving circuit includes a scanning line driving circuit 4*o* which drives scanning lines of odd-numbered rows, and a scanning line driving circuit 4*e* which drives scanning lines of even-numbered rows. The control signal FDON is directly supplied to the scanning line driving circuit 4*o* and signal line voltage control circuit 21. In addition, the control signal FDON is supplied to the scanning line driving circuit 4*e* via a delay circuit 25. Incidentally, the memory circuit, which has been described in connection with the first embodiment, is not adopted in the second embodiment.

According to this structure, the timing at which the control signal FDON changes from the low level to high level can be made different between the scanning line driving circuit 4*o* and the scanning line driving circuit 4*e*. In addition, in the second embodiment, unlike the first embodiment, since the memory circuit may not be provided, the flow of a large instantaneous VGL current can be suppressed with a simplified structure.

In the second embodiment, the scanning line driving circuits 4*o* and 4*e* are provided on both sides of the display area. However, aside from this configuration, the scanning line driving circuits 4*o* and 4*e* may be provided on one side.

Besides, in the first embodiment, the scanning line driving circuit 4 may be separated into two circuits, namely the scanning line driving circuits 4*o* and scanning line driving circuits 4*e*.

In the above-described embodiment, the source driver 5 and signal line voltage control circuit 21 may be constructed as one unit.

Furthermore, the polarity of the transistors used in the signal line voltage control circuit 21 may be changed from the P type to N type. At this time, the device may be configured such that the levels (high level, low level), at which the transistor operates, are reversed.

[Third Embodiment]

A third embodiment differs from the first and second embodiments in that the structures of the first and second embodiments are applied to an organic EL display device. The same parts as in the first embodiment are denoted by like reference numerals, and a detailed description thereof is omitted.

Figure 9:
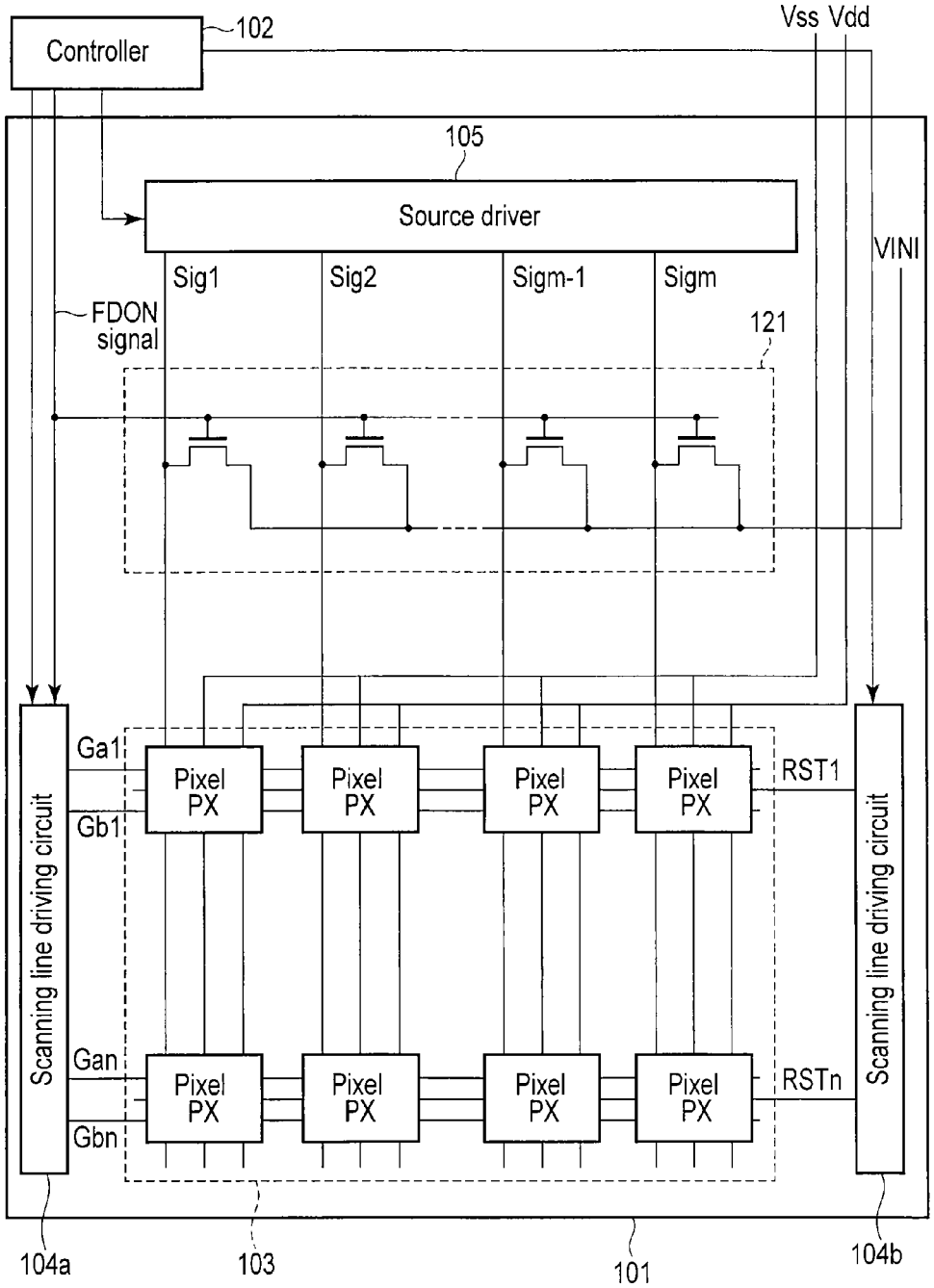
FIG. 9 is an exemplary block diagram illustrating a structure of a display device of a third embodiment.

FIG. 9 is a plan view illustrating a display device according to the third embodiment. As illustrated in FIG. 9, the display device includes an organic EL panel 101, and a controller 102 which controls the operation of the organic EL panel 101.

The organic EL panel 101 includes a display area 103, a scanning line driving circuit 104*a*, a scanning line driving circuit 104*b*, and a source driver 105.

The display area 103 includes (n×m) display pixels PX which are arrayed in a matrix on an insulative substrate with light transmissivity, such as a glass plate. First scanning lines Ga (1~n), second scanning lines Gb (1~n) and reset power lines RST (1~n) are disposed along rows in which display pixels PX are arranged, and are connected to the respective display pixels. In addition, an m-number of video signal lines Sig (1~m) are disposed along columns in which the display pixels PX are arranged, and are connected to the display pixels of the respective columns. Further, a high-potential power line Vdd and a low-potential power line Vss are connected to each display pixel. In the meantime, in each row of the display area 103, three display pixels PX for R (red) display, G (green) display and B (blue) display are alternately arranged.

The scanning line driving circuit 104*a* sequentially drives the first scanning lines Ga (1~n) and second scanning lines Gb (1~n) in units of a row of display pixels PX. The scanning line driving circuit 104*b* outputs a reset voltage VRST to the reset power lines RST (1~n). The source driver 105 drives plural video signal lines Sig (1~m). The scanning line driving circuits 104*a* and 104*b* and source driver 105 are integrally formed on the insulative substrate on the outside of the display area 103, and constitute, together with the controller 102, a control module.

In addition, on the insulative substrate, a signal line voltage control circuit (FDON circuit) 121 is provided. A control signal FDON is supplied from the controller 102 to the scanning line driving circuit 104*a* and signal line voltage control circuit 121. By this control signal FDON, control is executed to suppress a display defect (non-uniformity in display) at a time of power-on. The signal line voltage control circuit (FDON circuit) 121 includes a plurality of NMOS transistors which are connected to the respective signal lines. The control signal FDON is supplied to the gates of these NMOS transistors. Further, an initialization voltage VINI is supplied to the sources of these NMOS transistors.

Figure 10:
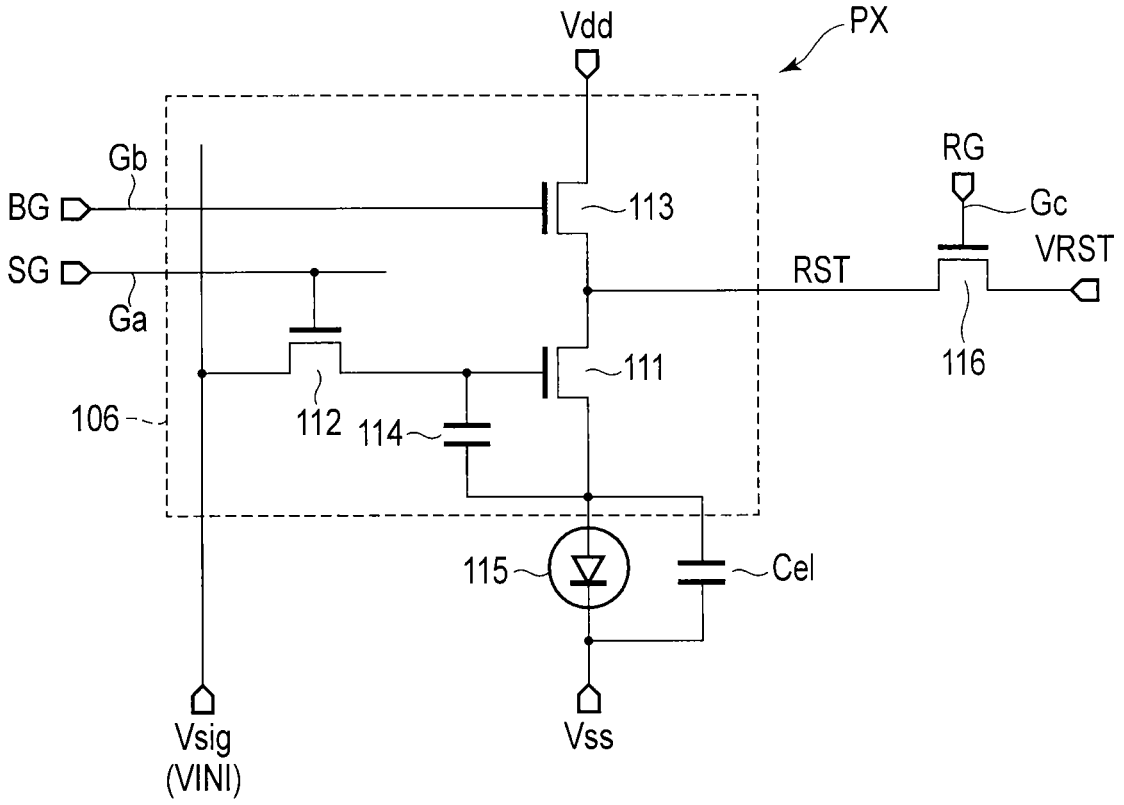
FIG. 10 is an exemplary view illustrating an equivalent circuit of a display pixel of the display device of the third embodiment.

FIG. 10 is a view illustrating an equivalent circuit of a display pixel of the display device of the third embodiment. Each display pixel PX functioning as a pixel module includes an organic EL element 115 which is a self-luminous element, and a pixel circuit 106 which supplies a driving current to the organic EL element 115.

The pixel circuit 106 of the display pixel PX shown in FIG. 10 is a pixel circuit by a voltage signal method, which controls light emission of the organic EL element 115 in accordance with a video signal which is composed of a voltage signal. The pixel circuit 106 includes a driving transistor 111, a pixel switch 112, an output switch 113, and a storage capacitance 114 functioning as a capacitor. In addition, the pixel circuit 106 is connected to a reset power line RST to which a reset voltage VRST is output from a reset switch 116 which is provided in the scanning line driving circuit 104*b*.

In the display device according to the third embodiment, the driving transistor 111, pixel switch 112 and output switch 113 are composed of TFTs (thin-film transistors) of the same conductivity type, for example, an N-channel type. In addition, the thin-film transistors, which constitute the driving transistor 111 and each switch, are all formed in the same fabrication steps with the same layer structure, and are, for instance, top-gate-type thin-film transistors using IGZO, a-Si or polysilicon for semiconductor layers. Incidentally, each switch is not limited to the N-channel type, and may be a P-channel type if the function as a switch is implemented.

Each of the driving transistor 111, pixel switch 112, output switch 113 and reset switch 116 includes a first terminal, a second terminal and a control terminal. In the description below, in some cases, the first terminal, second terminal and control terminal may be referred to as a source, a drain, and a gate, respectively.

In the pixel circuit 106 of the display pixel PX, for example, in a display pixel PX for green (G) display, the driving transistor 111 and output switch 113 are connected in series to the organic EL element 115 between a high-potential power line Vdd and a low-potential power line Vss. The power line Vdd is set at a potential of, e.g. 10 V, and the power line Vss is set at a potential of, e.g. −4 V.

In the output switch 113, the second terminal thereof, or the drain in this case, is connected to the power line Vdd, the first terminal thereof, or the source in this case, is connected to the reset power line RST and the second terminal, or the drain in this case, of the driving transistor 111, and the control terminal thereof, or the gate in this case, is connected to a second scanning line Gb. Thereby, the output switch 113 is ON (turn-on state)/OFF (turn-off state) controlled by a control signal BG from the second scanning line Gb, thus controlling the light emission time of the organic EL element 115.

In the driving transistor 111, the first terminal thereof, or the drain in this case, is connected to the source of the output switch 113 and the reset power line RST, and the second terminal thereof, or the source in this case, is connected to one terminal, or the anode in this case, of the organic EL element 115. The cathode of the organic EL element 115 is connected to the power line Vss. The driving transistor 111 outputs a driving current of a current amount, which corresponds to the video signal, to the organic EL element 115.

In the pixel switch 112, the second terminal thereof, or the drain in this case, is connected to a video signal line Sig, and the first terminal thereof, or the source in this case, is connected to the gate of the driving transistor 111. The gate of the pixel switch 112 is connected to a first scanning line Ga which functions as a gate line for signal write control, and is ON/OFF controlled by a control signal SG which is supplied from the first scanning line Ga. In response to the control signal SG, the pixel switch 112 controls connection/disconnection between the pixel circuit 106 and the video signal line Sig, and takes the video voltage signal into the pixel circuit 106 from the corresponding video signal line Sig.

The storage capacitance 114 has two opposed terminals, is connected between the gate and source of the driving transistor 111, and retains a gate control potential of the driving transistor 111 which is determined by the video signal.

The reset switch 116, which is provided in the scanning line driving circuit 104*b*, is connected between the drain of the driving circuit 111 and the reset power line RST in each of the rows. The gate of the reset switch 116 is connected to a third scanning line Gc which functions as a gate line for reset control. The reset switch 116 is ON (turn-on state)/OFF (turn-off state) controlled in accordance with a control signal RG from the third scanning line Gc, thereby initializing the source potential of the driving transistor 111.

On the other hand, the controller 102 shown in FIG. 9 is disposed on a printed circuit board which is disposed on the outside of the organic EL panel 101, and the controller 102 controls the scanning line driving circuits 104*a* and 104*b* and the source driver 105. The controller 102 receives a digital video signal and a sync signal, which are supplied from the outside, and generates, based on the sync signal, a vertical scanning control signal for controlling a vertical scanning timing, and a horizontal scanning control signal for controlling a horizontal scanning timing.

Then, the controller 102 supplies the vertical scanning control signal and horizontal scanning control signal to the scanning line driving circuits 104*a* and 104*b* and the source driver 105, and supplies the digital video signal and initialization signal to the source driver 105 in sync with the horizontal and vertical scanning timings.

The source driver 105 converts video signals, which are sequentially obtained in each horizontal scanning period by the control of the horizontal scanning control signal, to analog-format signals, and supplies gradation voltage signals Vsig of a plurality of gradation values, which include a video voltage signal for red, a video voltage signal for green and a video voltage signal for blue corresponding to the video signals, to a plurality of video signal lines Sig (1~m) in a parallel manner. In addition, the source driver 105 supplies initialization voltage signals to the plural video signal lines Sig (1~m) in a parallel manner in each 1 horizontal period.

The scanning line driving circuit 104*a* includes a shift register, an output buffer, etc., sequentially transfers a vertical scan start pulse, which is supplied from the outside, to the next stage, and supplies two kinds of control signals, namely SG (1~n) and BG (1~n), to the display pixels PX of each row via the output buffer. Thereby, the first scanning lines Ga (1~n) and second scanning lines Gb (1~n) are driven by the control signals SG (1~n) and BG (1~n), respectively.

The scanning line driving circuit 104*b* includes the reset switch 116, a shift register, an output buffer, etc., sequentially transfers a vertical scan start pulse, which is supplied from the outside, to the next stage, controls the reset switch 116 by the generated control signal RG (1~n), and supplies a reset voltage VRST to the display pixels PX of each row through the reset power line RST (1~n).

Next, a description is given of an operation at a time of power-on of the display device having the above-described structure.

At a time of power-on, the scanning line driving circuit 104*a* outputs a control signal BG of a level (OFF potential), or a low level in this case, which sets the output switch 113 in the OFF state, and a control signal SG of a level (ON potential), or a high level in this case, which sets the pixel switch 112 in the ON state. In addition, in the scanning line driving circuit 104*b*, the control signal RG is set at a level, or a high level in this case, which sets the reset switch 116 in the ON state.

Thereby, the output switch 113 is turned off (turn-off state) and the pixel switch 112 and reset switch 116 are turned on (turn-off state), the reset voltage VRST is supplied from the reset power line RST to the driving transistor 111, and the reset operation is started. Specifically, the potential of the source and drain of the driving transistor 111 is reset at a potential, for example, −3 V, which corresponds to the reset voltage VRST, and the potential state before power-on is initialized.

In addition, at the time of power-on, if the FDON signal goes to the high level, all NMOS transistors in the signal line voltage control circuit 21 are turned on, and the initialization voltage signal VINI is supplied to all signal lines. The initialization voltage signal VINI, which is output via the video signal line Sig (1~m), is applied to the gate of the driving transistor 111 via the pixel switch 112. Thereby, the gate potential of the driving transistor 111 is reset at the potential corresponding to the initialization voltage signal VINI, and is initialized from the state before power-on. The initialization voltage signal VINI is set at, for example, 1 V.

As has been described above, in the display device of the third embodiment, too, the display device can be set in the initial state, like the display devices of the first and second embodiments. Thus, by the provision of the same structure (FIG. 5 to FIG. 8) as the structures of the display devices of the first and second embodiments, an increase in instantaneous current due to the switching of the power supply voltage can be suppressed. In the meantime, since the mode of suppressing the increase in instantaneous current due to the switching of the power supply voltage in the display device of the third embodiment is the same as in the display devices of the first and second embodiments, a detailed description thereof is omitted.

As has been described above, the present invention is applicable to not only specific display devices, such as a liquid crystal display device, an organic EL display device and an inorganic EL display device, but also to a wide variety of general display devices.

According to each of the above-described embodiments, it is possible to suppress an increase in instantaneous current due to switching of a power supply voltage, also in a display device, such as FHD (full high-vision), having a higher resolution than conventional display devices. It is therefore possible to avoid such a situation that the load on the driving circuit increases, leading to a factor of the occurrence of a fault of the display device. Moreover, it is possible to prevent such a situation from occurring, that the specifications relating to an instantaneous current, which are required for the display device, are unachieved due to the increase in current.

While certain embodiments have been described, these embodiments have been presented by way of example only, and are not intended to limit the scope of the inventions. Indeed, the novel embodiments described herein may be embodied in a variety of other forms;

furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Various inventions can be made by properly combining structural elements disclosed in the embodiments. For example, some structural elements may be omitted from all the structural elements disclosed in the embodiments. Furthermore, structural elements in different embodiments may properly be combined.

What is claimed is:

1. A display device comprising:

signal lines and scanning lines extending in a first direction and a second direction respectively on an insulative substrate;

pixel switching elements formed near intersections between the signal lines and the scanning lines;

a signal line driving circuit configured to drive the signal lines;

a scanning line driving circuit configured to drive the scanning lines; and a display pixel, which comprises a pixel electrode connected to the pixel switching element and a counter-electrode opposed to the pixel electrode and a storage capacitance, wherein the signal line driving circuit is configured to apply a voltage, which is identical to a voltage of the counter-electrode, to all the signal lines when a control signal, which is supplied from an outside of the insulative substrate, is at a first logic level, the scanning line driving circuit comprises:

a shift register configured to shift a start signal;

a first output circuit configured to generate a first output signal based on the control signal supplied from outside of the insulative substrate and an output signal from the shift register; and a second output circuit configured to output a scanning signal, which controls turn-on/off of the pixel switching elements, to each of the scanning lines based on the first output signal and the output signal from the shift register, and the scanning line driving circuit is configured to turn on all the pixel switching elements when the control signal is at the first logic level, and to turn off the pixel switching elements at a timing of input of a shift signal from the shift register to the first output circuit when the control signal is at a second logic level.

2. The display device of claim 1, wherein the scanning line driving circuit is configured to turn off the pixel switching elements by sequentially selecting the scanning lines, when the control signal is at the second logic level.

3. A display device comprising:

signal lines and scanning lines extending in a first direction and a second direction respectively on an insulative substrate;

pixel switching elements formed near intersections between the signal lines and the scanning lines;

a signal line driving circuit configured to drive the signal lines;

a scanning line driving circuit configured to drive the scanning lines; and a pixel circuit provided in association with each of the pixel switching elements and configured to control a gradation of display, wherein the signal line driving circuit is configured to deliver a signal for initializing the pixel circuit to all the signal lines via the pixel switching elements when a control signal, which is supplied from an outside of the insulative substrate, is at a first logic level, the scanning line driving circuit comprises:

a shift register configured to shift a start signal;

a first output circuit configured to generate a first output signal based on the control signal supplied from the outside of the insulative substrate and an output signal from the shift register; and a second output circuit configured to output a scanning signal, which controls turn-on/off of the pixel switching elements, to each of the scanning lines based on the first output signal and the output signal from the shift register, and the scanning line driving circuit is configured to turn on all the pixel switching elements when the control signal is at the first logic level, and to turn off the pixel switching elements at a timing of input of a shift signal from the shift register to the first output circuit when the control signal is at a second logic level.

4. The display device of claim 3, wherein the scanning line driving circuit is configured to turn off the pixel switching elements by sequentially selecting the scanning lines, when the control signal is at the second logic level.

* * * * *